United States Patent [19]

Northcutt

[11] Patent Number: 4,869,196

[45] Date of Patent: Sep. 26, 1989

[54] COILED BOOKMARK

[76] Inventor: R. Randall Northcutt, 1201 B N. Sixth St., Longview, Tex. 75601

[21] Appl. No.: 268,952

[22] Filed: Nov. 9, 1988

[51] Int. Cl.[4] ..... B42D 9/00

[52] U.S. Cl. ..... 116/238; 116/234; 281/42

[58] Field of Search ..... 116/234–240; 281/1, 42

[56] References Cited

U.S. PATENT DOCUMENTS

| | | | |
|---|---|---|---|
| 865,092 | 9/1907 | Erickson | 116/238 |
| 1,168,159 | 1/1916 | Carson | 116/238 |
| 1,380,031 | 5/1921 | Abbott | 116/239 |
| 2,457,662 | 12/1948 | Hamilton | 116/239 |
| 2,539,687 | 1/1951 | Barsotti | 116/238 |
| 3,350,806 | 11/1967 | Davenport | 281/15 R |

FOREIGN PATENT DOCUMENTS

| | | | |
|---|---|---|---|
| 854946 | 4/1940 | France | 281/42 |
| 348147 | 9/1960 | Switzerland | 281/42 |
| 15561 | 7/1892 | United Kingdom | 281/42 |
| 601201 | 4/1948 | United Kingdom | 281/42 |

*Primary Examiner*—William A. Cuchlinski, Jr.
*Assistant Examiner*—W. Morris Worth
*Attorney, Agent, or Firm*—John M. Harrison

[57] ABSTRACT

A coiled bookmark which is designed for mounting on the book binding or spine of a book and is positioned in a cavity provided in the pages of the book adjacent to the spine, when not in use. The coiled bookmark is constructed of a resilient, preferably transparent material having a built-in "memory" or bias for selectively coiling in the bookmark cavity and extension from the bookmark cavity across selected open pages to mark the pages when the book is closed on the extended bookmark. Multiple coiled bookmarks may be provided in spaced relationship along the book spine for marking several pages simultaneously.

15 Claims, 1 Drawing Sheet

COILED BOOKMARK

BACKGROUND OF THE INVENTION

1. Field of the Invention

This invention relates to bookmarks and more particularly, to one or more coiled, resilient bookmark(s), each having one end mounted to the binding or spine of a book in a cavity or cavities provided in the pages at the point of attachment to the spine, wherein the opposite end of the bookmark(s) is extendible outwardly over selected pages to be marked and the book is closed, to mark these pages.

Bookmarks of various design, ranging from scraps of paper to ribbons and ornate, removable, metal, plastic and paper bookmarks are well known. One of the problems which is created by removable bookmarks is the occasional inadvertent removal of the bookmark from the book, wherein the page location is lost when the book is moved, jostled or dropped from a storage location. Furthermore, very thin, small bookmarks may slide downwardly between the pages of the book and lodge near the book spine, making location of the marked page difficult or impossible. Ribbons are very thin and opening of a book at the specific pages marked by the ribbon is usually difficult and sometimes causes fraying, folding or tearing of the page edge.

2. Description of the Prior Art

An early bookmark which is designed to mark a book laterally from the inside of the pages to the outside, is detailed in U.S. Pat. No. 865,092, dated Sept. 3, 1907, to K. Erickson. The Erickson bookmark includes an elongated marking member provided with an elastic band at one end, which elastic band is designed to fit around the book's spine and maintain the marking member in a selected horizontal position on a page. The bookmark serves not only to mark a specific page and passage in the book, but is also vertically and slidably-mounted on the elastic band to facilitate line-by-line reading of the words on the page. A "Book Marker" is detailed in U.S. Pat. No. 1,168,159, dated Jan. 11, 1916; to H. S. Carson. The book marker includes a pair of vertical members clamped to the front and back covers, respectively, of a book, a pair of laces connecting the vertical members at the top and bottom thereof, vertically-oriented marker supports slidably attached to the laces, which marker supports having multiple, transverse slots spaced therein, and further including indicating bars provided with extensions, clamped into the slots, to rigidly hold the indicating bars in a selected position on the marker supports, respectively. U.S. Pat. No. 1,380,031, dated May 31, 1921, to S. M. Abbott, details an "Adjustable Bookmark". The bookmark includes a pair of first members adapted for vertical attachment to the covers of a book, a resilient, flexible member extending between the first members at the top and bottom thereof and a second member removably supported by the resilient member and adapted to be positioned between the leaves of the book. Another "Bookmarker" is detailed in U.S. Pat. No. 2,457,662, dated Dec. 28, 1948, to J. W. Hamilton. This bookmarker is characterized by a pair of spaced, slotted members attached to the binding or spine of the book and multiple, vertically-oriented marker members slidably mounted in the slotted members for marking various pages of the book.

It is an object of this invention to provide a coiled bookmark which is attached to the binder or spine of a book and is adapted to be uncoiled outwardly of the spine to locate a selected page or pages in the book when the book is closed on the coiled bookmark.

Another object of this invention is to provide a coiled bookmark which is characterized by a resilient, coiled, extendible member having one end mounted to the spine or binder of the book and the other end extendible outwardly of the spine across a selected page against the bias in the coil, to mark the page when the book is closed on the extended bookmark.

Yet another object of this invention is to provide a new and improved coiled bookmark which is characterized by a normally inwardly-coiled, resilient member of selected thickness, width and length and having a memory or bias for coiling in a bookmark cavity, with one end of the bookmark attached to the spine or binder of the book and the opposite end extendible outwardly of the cavity and the spine or binder over a selected page to mark the page when the book is closed on the bookmark.

Still another object of the invention is to provide multiple coiled, resilient bookmarks, each of which is characterized by an elongated, coiled, resilient plastic material of selected width and thickness, the bookmarks each having one end attached to the spine of the book and located in spaced slots or in a common slot or cavity, wherein the opposite ends are extendible outwardly of the slot or cavity for marking a selected page or pages when the book is closed.

SUMMARY OF THE INVENTION

These and other objects of the invention are provided in one or more new and improved coiled bookmarks which are each characterized by an elongated, resilient, transparent plastic material having a memory or bias for automatically coiling into a tight coil or coils, one end of each of which bookmarks is attached to the spine or binder of a book in one or more slots or cavities provided in the pages thereof and the opposite end extendible outwardly of the spine over the pages in horizontal relationship against the bias in the coils, to mark a specific page or pages when the book is closed.

BRIEF DESCRIPTION OF THE DRAWING

The invention will be better understood by reference to the accompanying drawing, wherein.

DESCRIPTION OF THE PREFERRED EMBODIMENTS

Figure 1:
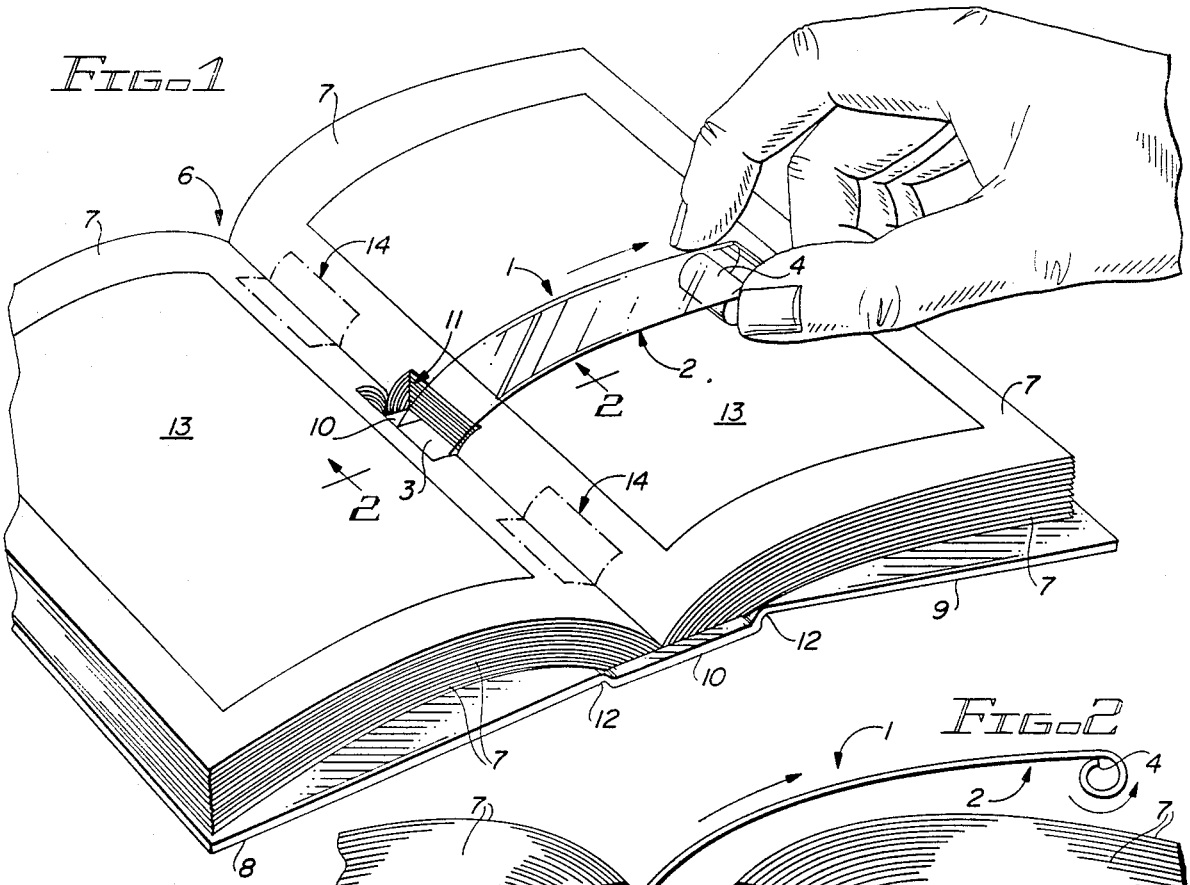
FIG. 1 is a perspective view of a preferred embodiment of the coiled bookmark of this invention, illustrated in partially deployed, functional configuration.
Figure 2:
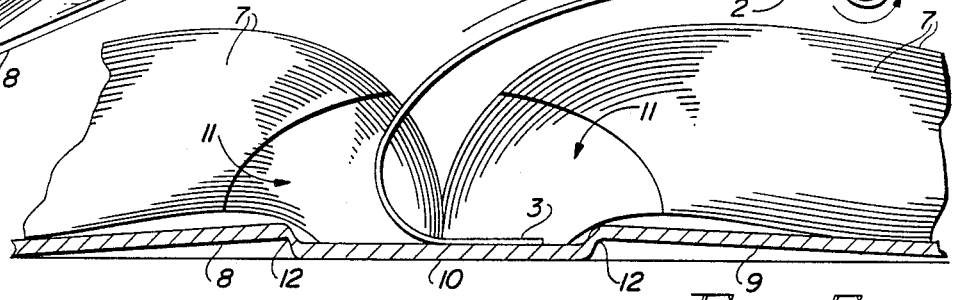
FIG. 2 is a sectional view taken along line 2—2 of the coiled bookmark illustrated in FIG. 1.
Figure 3:
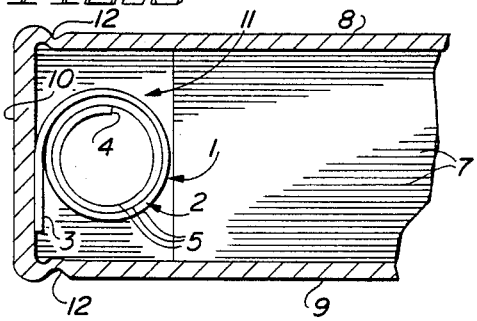
FIG. 3 is a sectional view of the coiled bookmark located inside a book in coiled, retracted, non-functional configuration when the book is closed.

Referring initially to FIGS. 1-3 of the drawings, in a preferred embodiment, the coiled bookmark of this invention is generally illustrated by reference numeral 1. The coiled bookmark 1 is characterized by a thin, resilient strip 2, having a cavity end 3 which is glued or otherwise secured to the binder or book spine 10 of a book 6, having a front cover 8, back cover 9 and multiple pages 7. The resilient strip 2 is provided with a built-in "memory", or bias, wherein it is normally coiled inside a bookmark cavity 11, as illustrated in FIG. 3 of the drawing, while the free end 4 of the resilient strip 2 can be extended from the bookmark cavity 11 as the resilient strip 2 is uncoiled, for marking a specific one of the pages 7, as illustrated in FIGS. 1 and 2. It will be appreciated that the resilient strip 2 can be coiled inwardly, toward the bottom thereof, as illustrated in FIGS. 1 and 2, or outwardly (not illustrated) toward the top thereof, as desired, in order to facilitate easily grasping the coils 5 and extending the resilient strip 2 across a selected one of the pages 7 as the coils 5 are unwound. As further illustrated in FIG. 3, the coiled bookmark 1 is normally disposed in coiled configuration in the bookmark cavity 11, with the free end 4 terminating inside the coils 5. The tightness of the coils 5 is determined by the material of construction and thickness of the resilient strip 2, as well as the technique for incorporating the resilient bias or "memory" into the resilient strip 2, as hereinafter further described.

Figure 4:
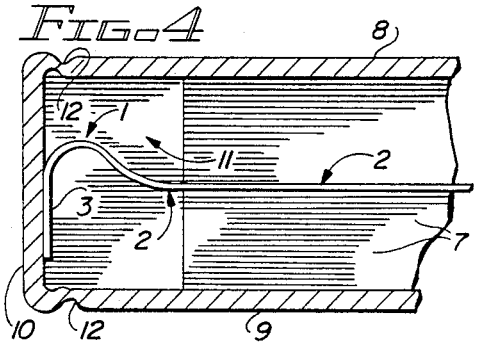
FIG. 4 is a sectional view of the coiled bookmark located inside the book in extended, fully functional configuration when the book is closed.
Figure 5:
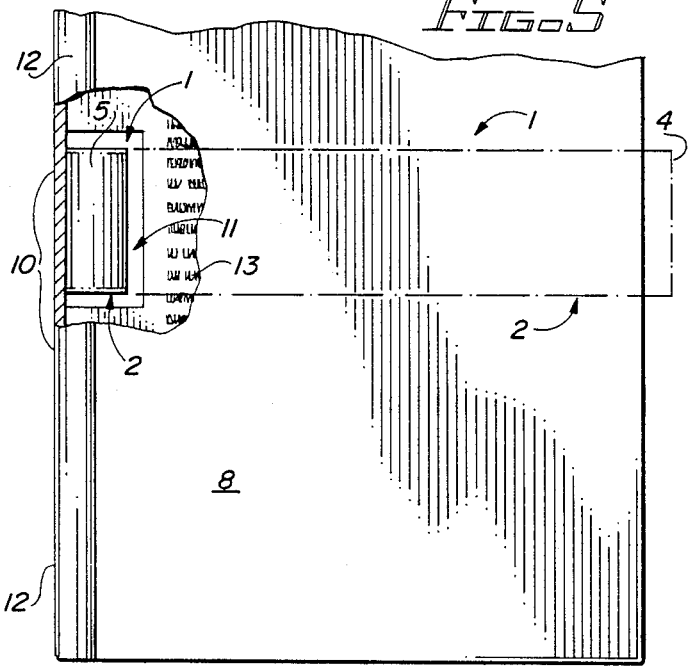
FIG. 5 is a top view, partially in section, of the bookmark configured both in retracted and extended (phantom) configuration in a book.

Referring now to FIGS. 4 and 5 of the drawing, after the resilient strip 2 is extended from the bookmark cavity 2 entirely across a selected one of the pages 7 with the free end 4 projecting past the edges of the pages 7, the book 6 may be closed along the fold margins 12, located in the front cover 8 and back cover 9, with the resilient strip 2 locating and marking a desired one of the pages 7, as illustrated in FIG. 4. The extending free end 4 of the resilient strip 2 serves as a tab which can be easily grasped, in order to quickly and easily open the book 6 of the specific and desired page 7, without damaging the edges of the overlying or underlying page or pages.

As further illustrated in FIG. 1, alternate bookmark locations 14, illustrated in phantom, can also be used for locating additional bookmark cavities 11 and insertion of additional coiled bookmarks 1, according to the desires of the user. This feature is useful under circumstances where multiple pages 7 are to be marked for future reference. Alternatively, a single, continuous slot or cavity (not illustrated) can be provided in the pages 7 for mounting and selectively deploying multiple units of the coiled bookmark 1 and simultaneously marking selected pages 7, as desired. Furthermore, in a most preferred embodiment of the invention, the resilient strip 2 is transparent and is constructed of a thin, plastic material of selected thickness and width, which is shaped with a built-in "memory", bias or resiliency necessary to facilitate coiling into the bookmark cavity 11 when the free end is released. For example, certain plastic materials such as polyethylene and polypropylene, in non-exclusive particular, may be used to construct the resilient strip 2, as desired. The transparent nature of the resilient strip 2 allows clear viewing of the passages 13 on each of the pages 7 when the resilient strip 2 is extended across the respective pages 7.

It will be appreciated by those skilled in the art that the necessary resiliency or bias can be incorporated into the resilient strip 2 of the coiled bookmark 1 by several techniques. First, the resilient strip 2 can be molded with a coil memory or bias provided therein. Alternatively, the resilient strip 2 can be cut or shaped into the desired size, rolled into the coiled configuration and heated to maintain the required resiliency in the coils 5. Other methods of incorporating a memory, bias or resiliency into the coils 5 of a resilient strip 2 for use according to the purpose of this invention may be determined by those skilled in the art.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A coiled bookmark for a book having a spine, said coiled bookmark comprising an elongated, resilient member provided with a bias for normally orienting said resilient member in the coil, said resilient member having one end secured to the spine of the book and an opposite end of said resilient member is disposed inside the coil which is coiled against said one end responsive to said bias when said bookmark is in non-functional configuration, said resilient member being extendible against said bias across a selected page in the book when the book is open, to mark the page when the book is closed on said resilient member.

2. The coiled bookmark of claim 1 wherein said resilient member is substantially transparent.

3. The coiled bookmark of claim 1 wherein said opposite end of said resilient member is coiled inwardly, toward the secured end of said resilient member responsive to said bias.

4. The coiled bookmark of claim 1 wherein:

(a) said resilient member is substantially transparent; and (b) said opposite end of said resilient member is coiled inwardly, toward the secured end of said resilient member responsive to said bias.

5. The coiled bookmark of claim 1 wherein the pages of the book contain a cavity located adjacent to the spine and wherein said one end of said resilient member is secured to said spine inside the cavity and said resilient member is coiled in the cavity when said bookmark is in said non-functional configuration.

6. The coiled bookmark of claim 5 wherein said resilient member is substantially transparent.

7. The coiled bookmark of claim 5 wherein said opposite end of said resilient member is coiled inwardly, toward the secured end of said resilient member responsive to said bias.

8. The coiled bookmark of claim 5 wherein:

(a) said resilient member is substantially transparent; and (b) said opposite end of said resilient member is coiled inwardly, toward the secured end of said resilient member responsive to said bias.

9. A coiled bookmark for marking selected pages of a book having a spine, with the pages attached to the spine and a cavity provided in the pages of the book at the spine of the book, said coiled bookmark comprising an elongated, flat, resilient member provided with a bias for normally orienting said resilient member provided with a bias for normally orienting said resilient member in a coil, said resilient member having one end secured to the spine and within the cavity and the opposite end of said resilient member is disposed inside the coil which is coiled against said one end, the coil is in the cavity when said bookmark is oriented in non-marking configuration and wherein said resilient member is extendible across a selected page in the book to mark the page when the book is closed on said resilient member, said opposite end projecting beyond the pages of the closed book and serving as a graspable tab.

10. The coiled bookmark of claim 9 wherein said resilient member is substantially transparent.

11. The coiled bookmark of claim 10 wherein said opposite end of said resilient member is coiled inwardly, toward the secured end of said resilient member responsive to said bias.

12. Coiled bookmarks for marking the pages of a book which are attached to a spine provided in the book, wherein the pages include at least two cavities provided in the pages of the book in spaced relationship at the spine of the book, said coiled bookmarks comprising a pair of elongated, flat resilient members, each provided with a bias for normally orienting said resilient members in a coil, said resilient members having one end secured to the spine and within said cavities, respectively, and the opposite end of said resilient member is disposed inside the coil which is coiled against said one end in said cavities, respectively, when said bookmark is oriented in non-functional, retracted configuration and wherein said resilient members are individually extendible across selected pages in the book to mark the pages when the book is closed on said resilient members.

13. The coiled bookmarks of claim 12 wherein said cavities are connected to define a slot and further comprising additional elongated, flat, resilient members, each provided with a bias for normally orienting said resilient members in a coil an each of said resilient members having one end secured to the spine in said slot in spaced relationship with respect to said pair of elongated, flat resilient members, for simultaneously marking multiple pages of the book.

14. The coiled bookmarks of claim 13 wherein at least one of said resilient members is transparent.

15. The coiled bookmarks of claim 14 wherein said opposite ends of said resilient members are coiled inwardly, toward the secured end of said resilient members, respectively.

* * * * *